US005516476A

United States Patent [19]

Haggard et al.

[11] Patent Number: 5,516,476

[45] Date of Patent: May 14, 1996

[54] PROCESS FOR MAKING A FIBER CONTAINING AN ADDITIVE

[75] Inventors: Jeff S. Haggard, Cocoa; Bryan Norcott, Palm Bay, both of Fla.

[73] Assignee: Hills, Inc,, Melbourne, Fla.

[21] Appl. No.: 337,531

[22] Filed: Nov. 8, 1994

[51] Int. Cl.[6] ..... D01F 1/04

[52] U.S. Cl. ..... 264/211; 264/349

[58] Field of Search ..... 264/78, 211, 349

[56] References Cited

U.S. PATENT DOCUMENTS

| | | | |
|---|---|---|---|
| 1,955,825 | 4/1934 | Palmer | 264/171 |
| 2,070,194 | 2/1937 | Bartunek et al. | 106/164 |
| 3,180,912 | 4/1965 | Rowe, Jr. | 264/171 |
| 4,259,277 | 3/1981 | Hill | 264/75 |
| 4,338,274 | 7/1982 | Hill | 264/211 X |
| 4,340,552 | 7/1982 | Roberts | 264/39 |
| 4,406,850 | 9/1983 | Hills | 364/171 |
| 4,648,826 | 3/1987 | Ogasawara et al. | 425/192 S |
| 4,684,488 | 8/1987 | Rudolph | 264/40.2 |
| 4,849,113 | 7/1989 | Hills | 210/741 |
| 5,162,074 | 11/1992 | Hills | 156/644.1 |
| 5,234,650 | 8/1993 | Hagen et al. | 264/176.1 |
| 5,244,614 | 9/1993 | Hagen | 264/78 |
| 5,364,582 | 11/1994 | Lilly | 264/211 |

*Primary Examiner*—Leo B. Tentoni

[57] ABSTRACT

A multiplate spin pack receives metered molten polymer and metered amounts of additive components selectively proportioned to produce desired characteristics in extruded fiber. The additive components are mixed together and blended with the polymer by passage through a pattern of mixer channels formed in opposed faces of spin pack mix plates immediately upstream of the spinning orifices of a spinneret. Mixing is produced by splitting the fluids into multiple paths and repeatedly converging the paths into boundary layer contact. Short flow paths of mixed polymer minimizes time and waste in change over procedures.

24 Claims, 12 Drawing Sheets

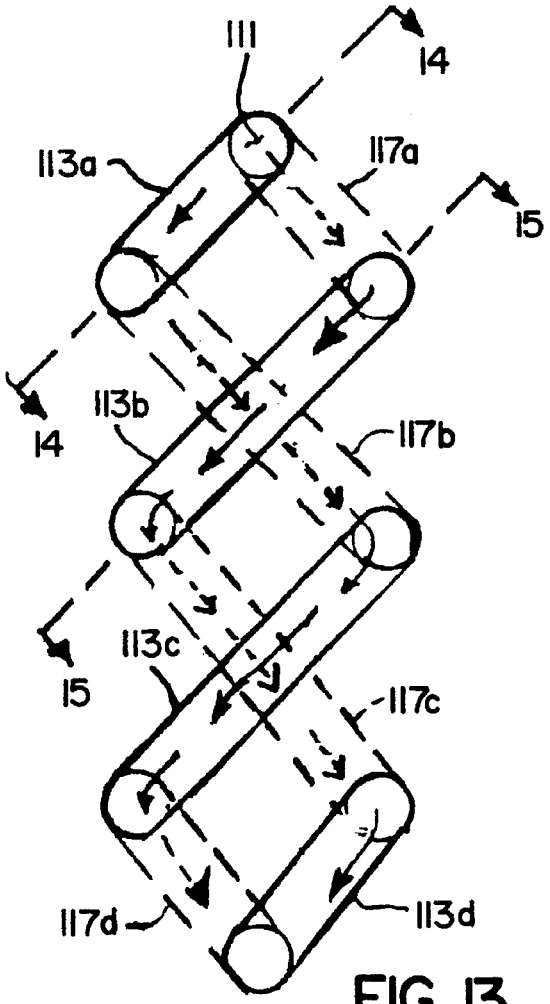
FIG. 13
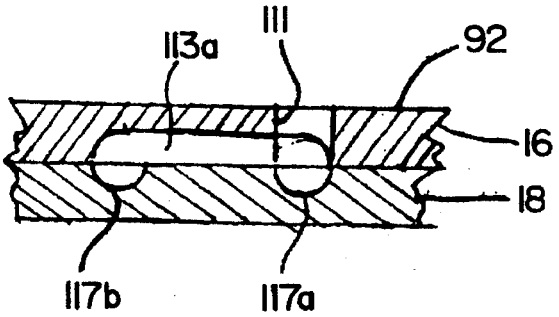
FIG. 14
FIG. 15
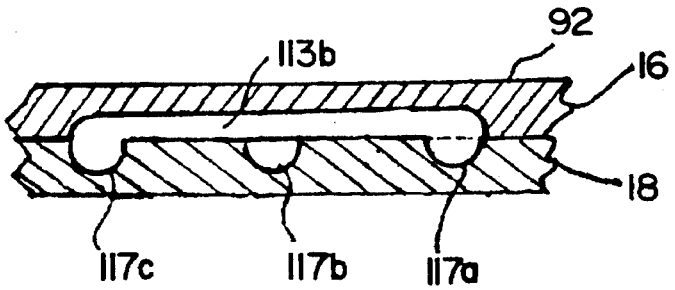

PROCESS FOR MAKING A FIBER CONTAINING AN ADDITIVE

BACKGROUND OF THE INVENTION

1. Technical Field

The present invention relates to a method and apparatus for rapidly changing constituent components and reducing change over waste in the extrusion process of manufacturing synthetic fiber. More particularly, the present invention relates to an improved system for proportioning, mixing and distributing components, such as color pigments, with a base polymer to selectively deliver flow streams of a wide range of colors or other characteristics to spinneret extrusion holes.

2. Discussion of the Prior Art

Synthetic fibers are produced by pumping fluid polymer through an assembly called a spin pack consisting of a series of component plates that collectively filter, distribute and finally extrude the fibers through fine holes into a collection area. Multi-component fibers (i.e., fibers consisting of more than one type of polymer) are extruded from spin packs having one or more distribution plates having slots, channels and capillaries arranged to deliver the polymer from one, or a few, inlets to the hundreds of extrusion holes. Exemplary of such spin pack assemblies are those disclosed in U.S. Pat. No. 5,162,074 (Hills) consisting of, in order, an upstream top or inlet plate, a filter screen support plate, a metering plate that communicates filtered melt to an etched distribution plate that in turn disperses the melt laterally to multiple extrusion through-holes formed in a final downstream spinneret plate.

The addition of coloring pigments or dyes to the polymer melt has been generally performed outside and upstream of the spin pack with the cost-inefficient result that the entire pack has to be cleaned or flushed between each change in fiber color. Representative of this longstanding approach is U.S. Pat. No. 2,070,194 (Bartunek, et al) disclosing a system characterized by premixing separate batches of cellulosic solutions with a plurality of primary colors, pumping selected proportions of the various colored solutions into a common mixing tank to produce a desired fiber color, and then pumping the mixed solution to a filament forming machine.

An alternative approach, exemplified by U.S. Pat. No. 5,234,650 (Hagen et al) pumps three or more streams of differently colored premixed polymer to a program plate directly upstream of the spinneret. The program plate blocks, meters or permits free flow of each of the streams into the active backholes. Color or component combinations are controlled by flows permitted to reach each backhole, but the program plate must be replaced to change the characteristics of the fiber or yarns produced and this creates delays and expense. Moreover, no effort is made to actively mix the color combinations beyond the merging of flows.

The delivery of metered amounts of separated polymeric components to spinneret nozzles to extrude combined multi-component fibers, particularly trilobal fibers having abutting sheaths and cores of different characteristics, is illustrated by U.S. Pat. No. 5,244,614 (Hagen) but again no teaching of the utility of, or procedure for, homogeneously mixing the separate components is provided. Instead the molten polymer is merged into a single capillary communicating directly with the extruding orifice.

The known prior art nowhere presents a technique nor an apparatus for selectively combining and mixing constituent fiber components, such as pigments or precolored polymer streams, immediately upstream of the spinneret in a continuous flow process. Such a procedure would reduce processing interruptions, expenses and waste by minimizing the residence time and consequently the constituent material required to effect a transition from a fiber of one selected characteristic to another.

OBJECTS AND SUMMARY OF THE INVENTION

It is an object of the present invention to provide an improved method and apparatus for producing instant mixture changes in spin pack synthetic fiber manufacturing.

It is also an object of this invention to minimize residence time of mixed polymers in a spin pack.

It is another object of the present invention to provide spin pack mixer plates that mix constituent components with core melt in close proximity to the spinneret orifices.

It is a further object of the present invention to provide a spin pack that locates mixing of components together, mixing of components with core melt, and distribution of mixed melt to spinneret orifices all at the same level in the spin pack immediately upstream of the spinneret.

It is yet another object of the present invention to produce mixing of fiber components together and mixing of additive components with core melt using no moving parts, instead using boundary layer effects resulting from adjacently criss-crossing flow paths.

The aforesaid objects are achieved individually and in combination, and it is not intended that the invention be construed as requiring that two or more of said objects be combined.

In accordance with the present invention a spin pack is provided with adjacently disposed upstream and downstream mix plates located between an upstream screen support plate and a downstream spinneret plate. The adjacent sides of the mix plates have channels defined in partial registry one with the other to form therebetween a plurality of criss-crossing distribution flow paths each alternating from one plate to the other at the criss-cross or crossover points in a basketweave or similar configuration. Mixing of components together, such as pigments and mixed pigments with core melt, and pigmented melt with pigmented melt is achieved by the boundary layer interactions occurring at the flow path crossovers. The basketweave-like design creates 180° rotations of each flow path between crossovers, thereby alternating the flow sides making boundary layer contact at successive crossovers to produce more efficient and quicker mixing. The number of crossovers is varied to control the degree and type of mixing consistent with fiber effects desired.

The present invention permits the proportioning and mixing of a few colors to produce a complete array of end product colors, and the close proximity of the mixing process to the spinneret minimizes the cleaning, flushing time and waste involved in a change over.

The above and still further objects, features and advantages of the present invention will become apparent upon considering the following detailed description of specific embodiments thereof, particularly when viewed in conjunction with the accompanying drawings wherein like reference numbers in the various figures are utilized to designate like components.

BRIEF DESCRIPTION OF THE DRAWINGS

FIG. 13 is a schematic diagram of pigment flow through mixer channels formed between the first and second mix plates of FIGS. 8–11.

FIG. 14 is a section view taken along lines 14—14 of FIG. 13.

FIG. 15 is a section view taken along lines 15—15 of FIG. 13.

DESCRIPTION OF THE PREFERRED EMBODIMENTS

Figure 1:
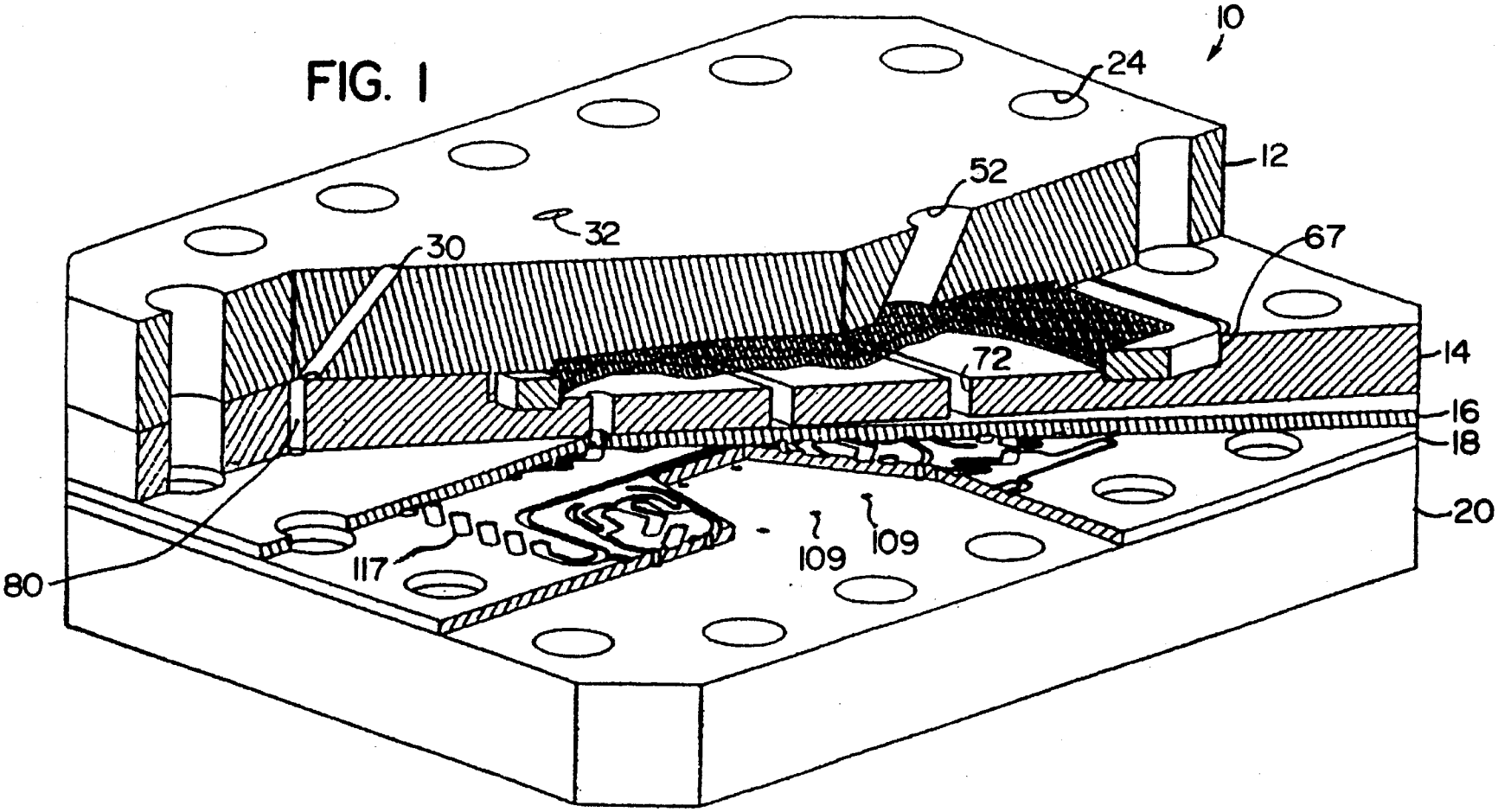
FIG. 1 is a partially broken prospective view of a spin pack assembly constructed in accordance with the principles of the present invention.

Referring specifically to FIG. 1–12 of the accompanying drawings, a spin pack 10 is assembled from five stacked plates, held in successive juxtaposition. These plates, in order from top or upstream side to bottom or downstream side are a top plate 12, a screen support plate 14, a first upstream distribution and mix plate 16, a second downstream distribution and mix plate 18 and a spinneret plate 20. Plates 12, 14, 16, 18 and 20 are secured tightly together, for example by bolts extending from spinneret plate 20 through appropriately aligned bolt holes 24 formed in each plate and secured by nuts upstream of top plate 12.

Three inlet ports 28, 30 and 32 are formed near one end of the upstream surface 34 of the top plate 12, separated from each other sufficiently to allow metering pumps 36, 38 and 40, respectively, to be uninterferingly connected thereto. Passageways 42, 44 and 46 extend through plate 12 between upstream ports 28, 30 and 32, respectively, and the downstream surface 48 of top plate 12, converging into a single component outlet port 50. An additional inlet port 52 on the upstream surface 34 of top plate 12 is separated from ports 28, 30 and 32 sufficiently to allow a base polymer pump 54 to be uninterferingly connected thereto. A recess or cavity 56 formed in the downstream surface 48 of top plate 12 flares or diverges in a downstream direction. Cavity 58 has a rectangular shaped outlet 58 at downstream surface 48 and a somewhat smaller axially aligned rectangular base surface 60 located between downstream surface 48 and upstream surface 34. A passageway 62 communicates through plate 12 between base polymer inlet port 52 and an output port 64 at surface 60 of cavity 56.

A shallow rectangular recess or cavity 65, similarly sized and aligned with the base 58 of flared rectangular cavity 56 in top plate 12, is formed in the upstream surface 66 of screen support plate 14. Cavity 65 is sized to receive a removable filter screen 67.

Four spaced polymer supply slots 68, 70, 72 and 74, aligned perpendicular to the long sides of cavity 65 and spanning most of the width of cavity 65 extend through screen support plate 14 from cavity 65 to downstream surface 76. An inlet port 78 on the upstream surface 66 of screen support plate 14 is aligned and communicates with component outlet port 50 on the downstream surface 48 of top plate 12. Passageway 80 (FIG. 1) extends from inlet port 78 through screen support plate 14 to an outlet port 82 located on downstream surface 76.

A series of shallow channels are formed on the downstream surface 96 of first mix plate 16 that mate with similar channels formed in adjacently opposed surface 97, the upstream surface of second mix plate 18. Distribution and mix plates 16 and 18 are preferably thin stainless steel plates photochemically etched or otherwise formed to produce conduits for the flow of additive components and polymer in an interactive pattern to mix the components uniformly with the base polymer and then to distribute the mixture to the extruding spinneret. Alternatively, the conduits or channels could be defined in the adjacently opposed plate faces by laser engraving, EDM or any other suitable means. Some of the channels on the two surfaces are in complete registry to form passageways to conduct and distribute additive components and base polymer, while other opposed or facing sets of channels are in partial registry only. The partially registered channels form mixing zones at their crossing intersections to blend the incompletely mixed additive component stream input through passageway 80 and to mix the resultant combined components with base polymer to produce selected fiber characteristics.

First or upstream mix plate 16 has eight polymer supply through-holes 84–91 arranged in two spaced linear rows such that through-holes 84 and 85 align in registry with the opposite ends of throughslot 68 in screen support plate 14, through-holes 86 and 87 align in like registry with opposite ends of throughslot 70, through-holes 88 and 89 align in like registry with opposite ends of slot 72 and through-holes 90 and 91 align in like registry with the ends of slot 74.

Separate sets of individual partitioned polymer-additive component mixer channels 94 are formed in the downstream surface 96 of first mix plate 16, each in communication with one of polymer supply through-holes 84–91. In the embodiment of FIG. 1 the additive components are color pigments and mixer channels 94 are polymer pigment mixer channels, although additive components contributing fiber characteristics of any sort could be metered into the spin pack to create selected fiber mixtures. The upstream surface 97 of second mix plate 18 has sets of partitioned polymer-pigment mixer channels 99 in partial registry with channel sets 94 but generally aligned perpendicular to the channels of sets 94 in a criss-cross pattern such that registry and thus communication is effected at the opposite ends of opposed channels and at intersecting cross-overs located at about midlength forming individual polymer-pigment mixing zones.

Distribution channels 101, having four divergent legs 103, are defined adjacent polymer-pigment mixer sets 94 on surface 96. Similar channels 105 and legs 107 are defined in surface 97 in complete registry with channels 101 and legs 103. Legs 107 terminate in through-holes 108 communicating through second mix plate 18 in registry with spinneret extrusion nozzles 109 passing through spinneret plate 20.

A pigment inlet port 110 at upstream surface 92 of first mix plate 16 is in registry with pigment outlet port 82 at downstream surface 76 of screen support plate 14 and communicates via short passageway 111 with a row of short diagonal parallel pigment mixer channels 113 defined in downstream surface 96. The last of these channels, the one furthest from pigment inlet passageway 111, communicates with each of the polymer supply through-holes 84–91 and hence with mixer channels 94, via a pigment supply channel 115, formed in downstream surface 96.

Upstream surface 97 of second mix plate 18 has a row of short diagonal parallel pigment mixer channels 117 defined in partial registry with the row of pigment mixer channels 113 in first mix plate 16. The direction of diagonal mixer channels 117 is generally perpendicular to mixer channels 113 and registry is effected at the channel ends and at intersecting cross-overs preferably located midway between ends. A pigment supply channel 119 is defined in second mix plate 18 in registry with supply channel 115 of first mix plate 16.

Figure 2:
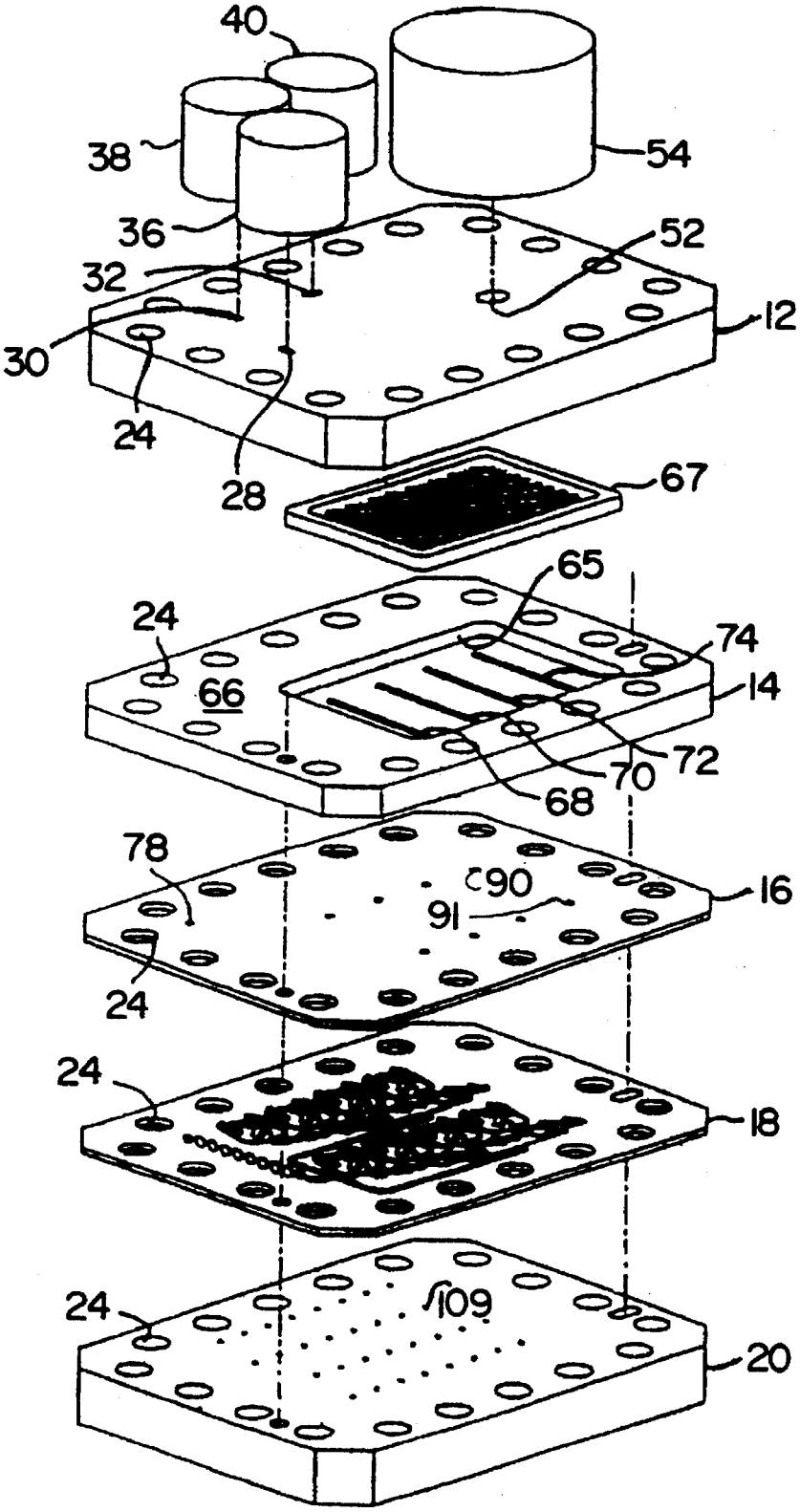
FIG. 2 is an exploded perspective view of the spin pack assembly of FIG. 1.
Figure 4:
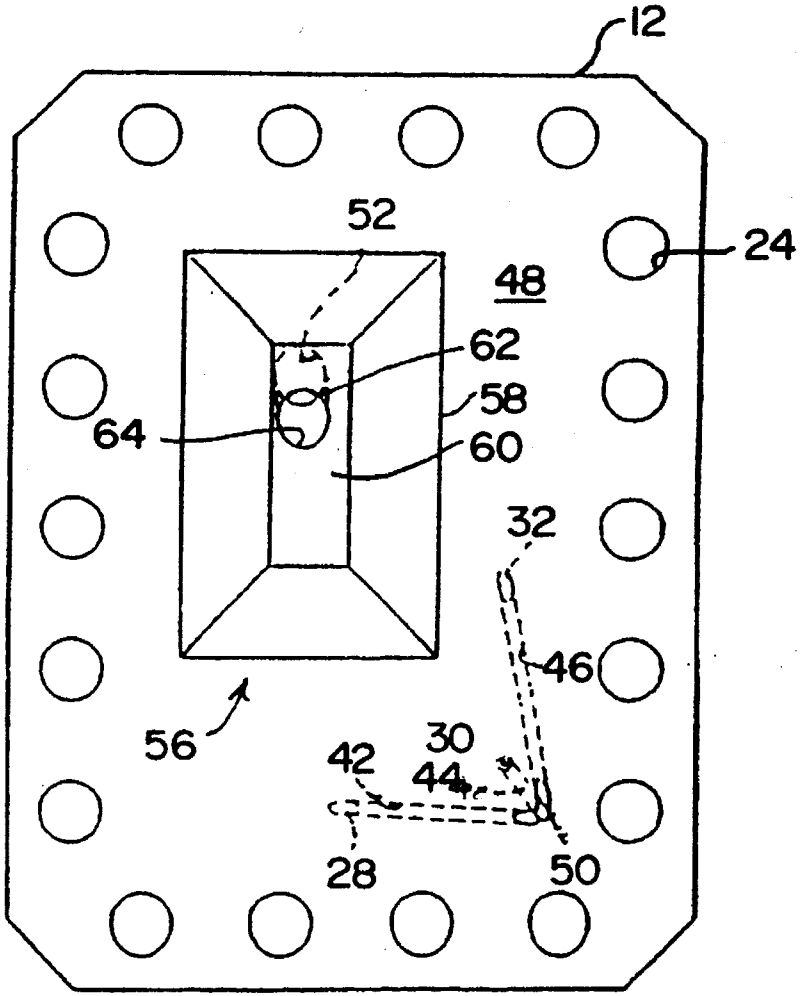
FIG. 4 is a bottom view in plan of the top plate of the spin pack assembly of FIG. 1.
Figure 3:
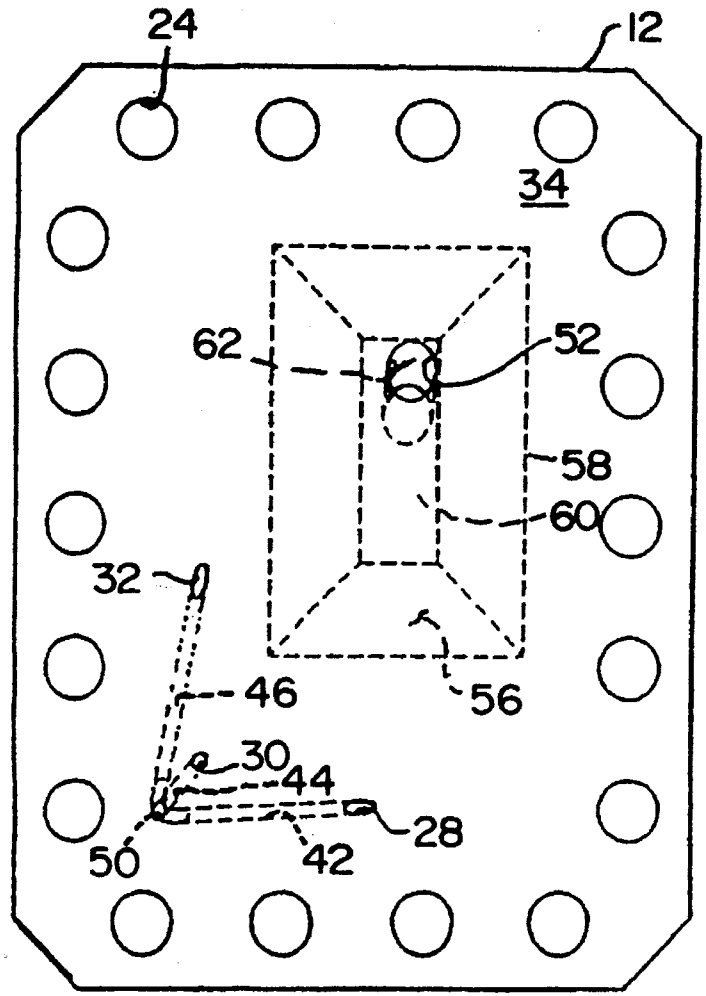
FIG. 3 is a top view in plan of the top plate of the spin pack assembly of FIG. 1.
Figure 5:
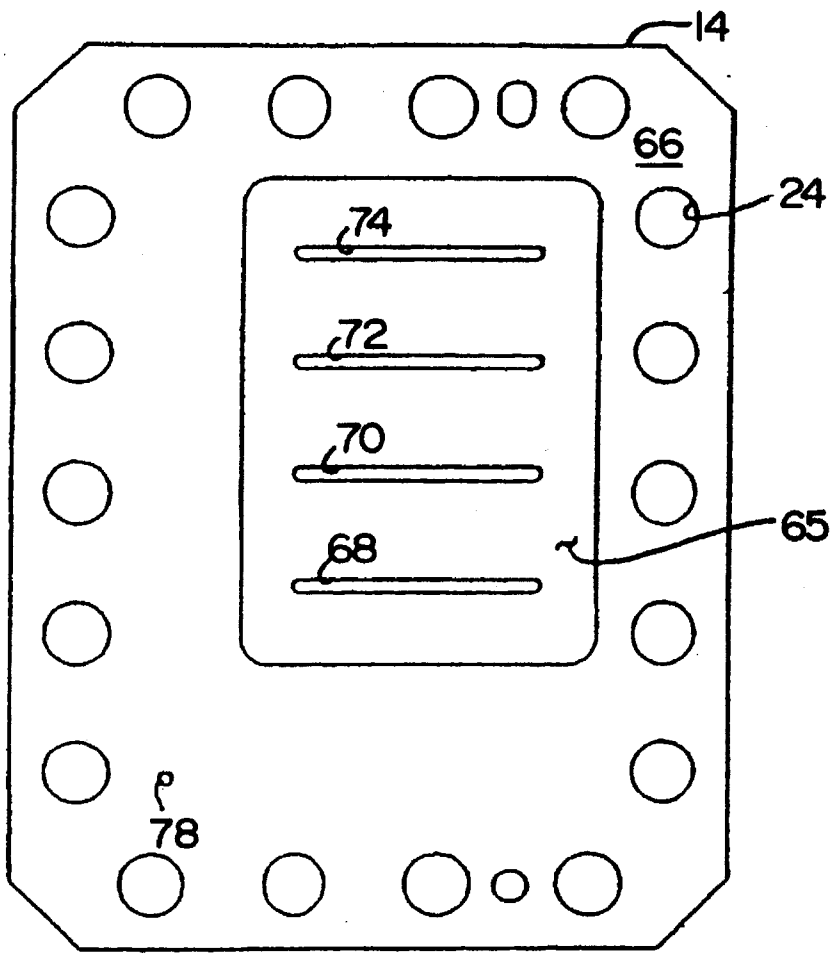
FIG. 5 is a top view in plan of the screen support plate of the spin pack assembly of FIG. 1.
Figure 6:
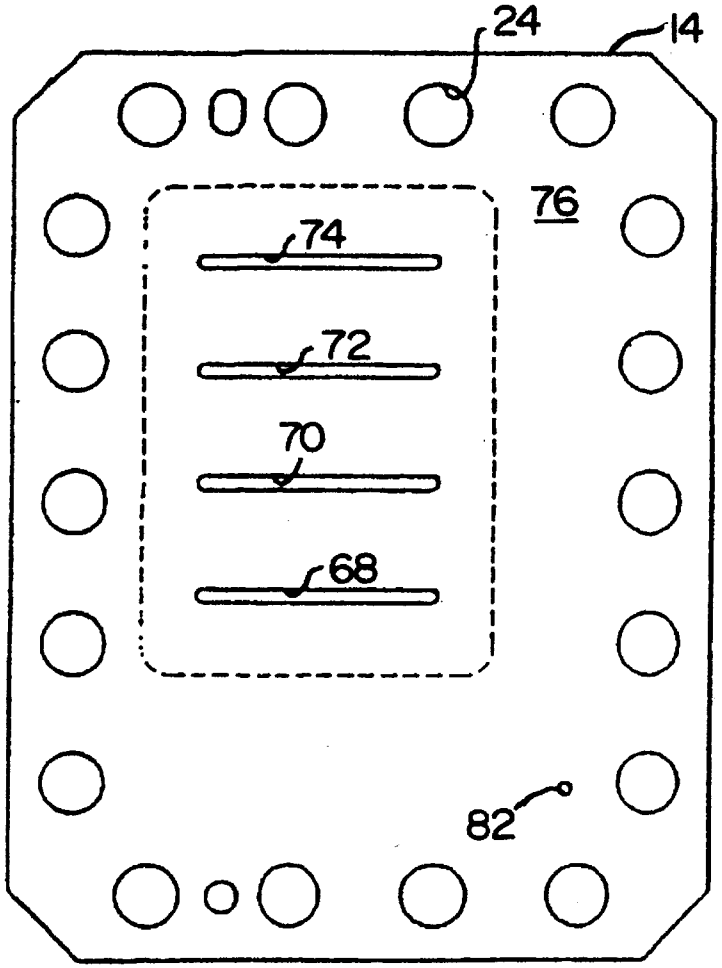
FIG. 6 is a bottom view in a plan of the screen support plate of the spin pack assembly of FIG. 1.
Figure 12:
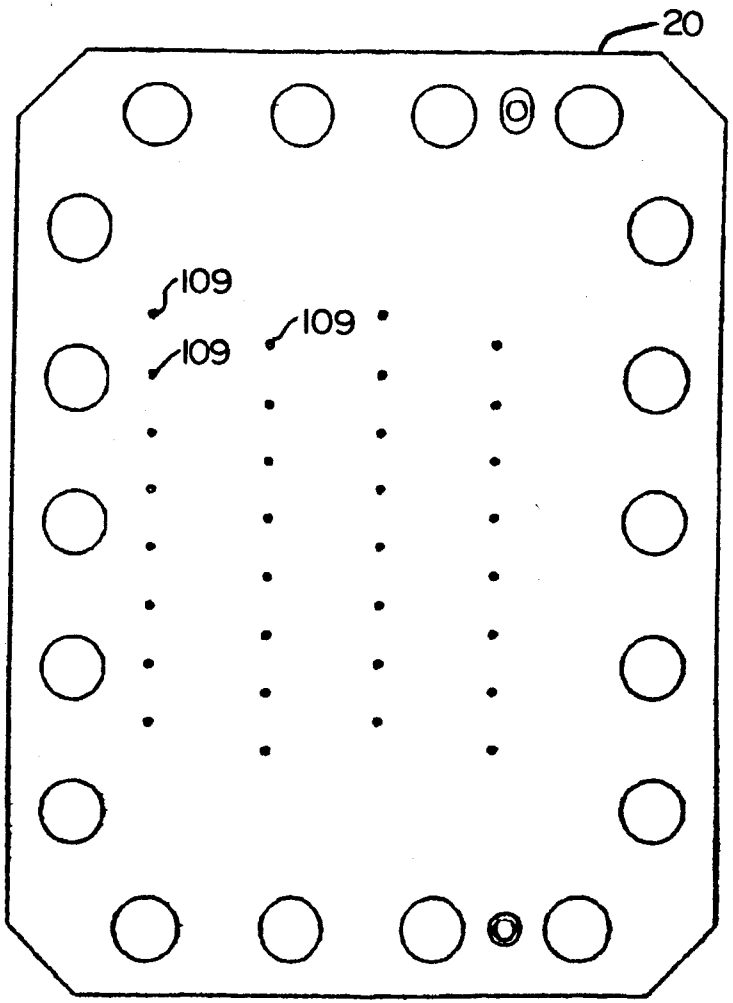
FIG. 12 is a top view in plan of the spinneret plate of the spin pack assembly of FIG. 1.
Figure 7:
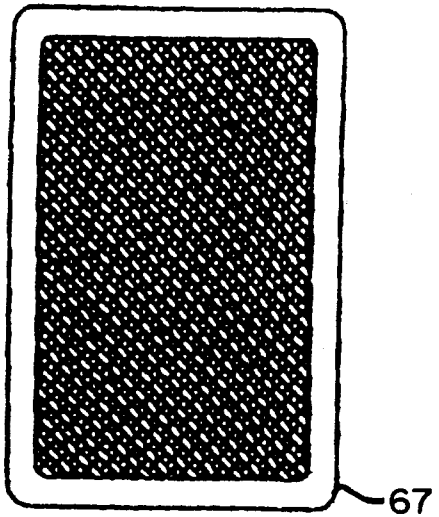
FIG. 7 is a top view in plan of the filter screen of the spin pack assembly of FIG. 1.
Figure 8:
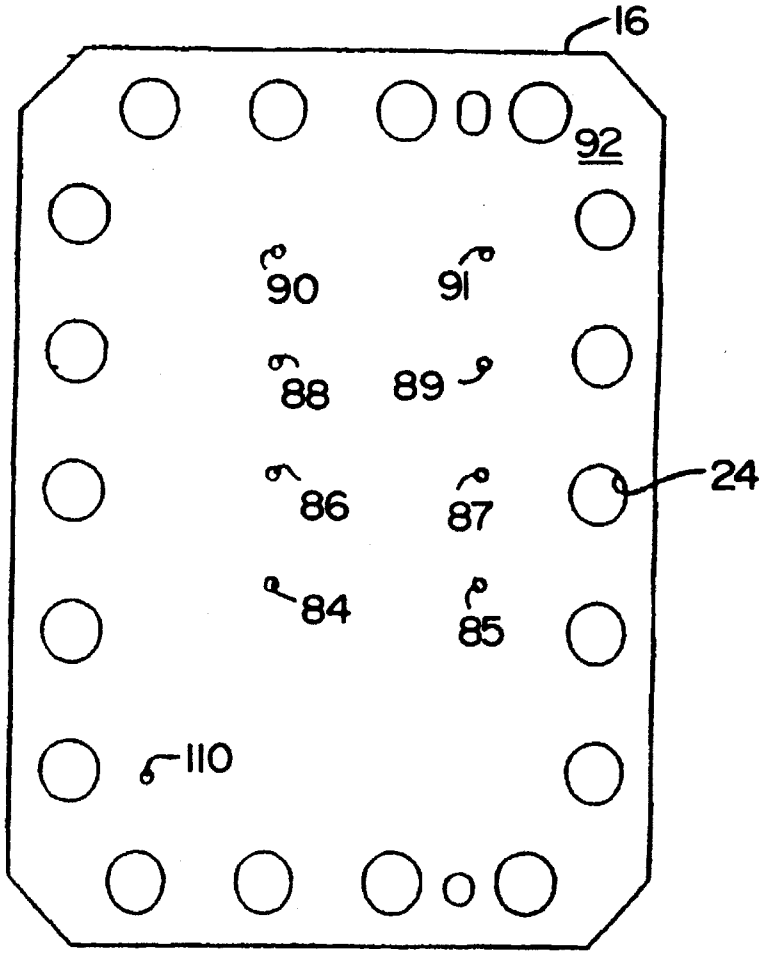
FIG. 8 is a top view in plan of the first or upstream distribution and mix plate of the spin pack assembly of FIG. 1.
Figure 9:
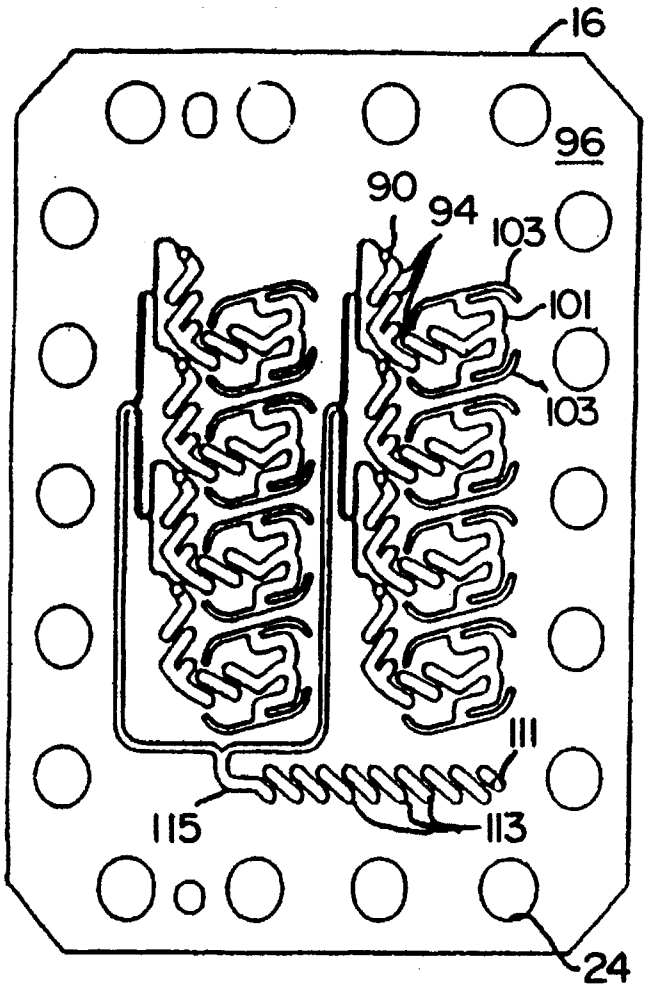
FIG. 9 is a bottom view in plan of the first or upstream distribution and mix plate of the spin pack assembly of FIG. 1.
Figure 10:
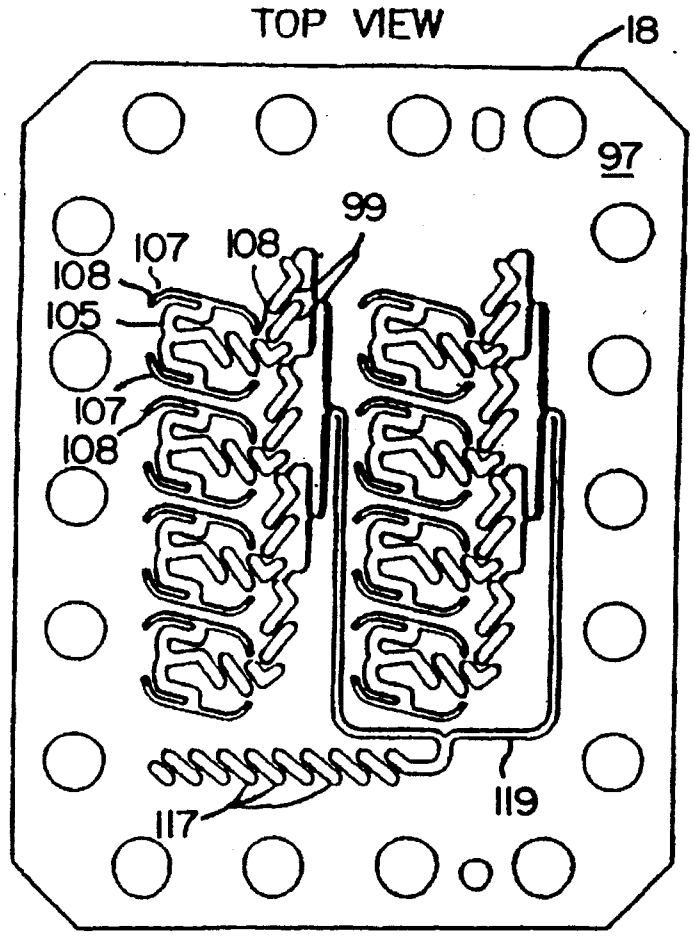
FIG. 10 is a top view in plan of the second or downstream distribution and mix plate of the spin pack assembly of FIG. 1.
Figure 11:
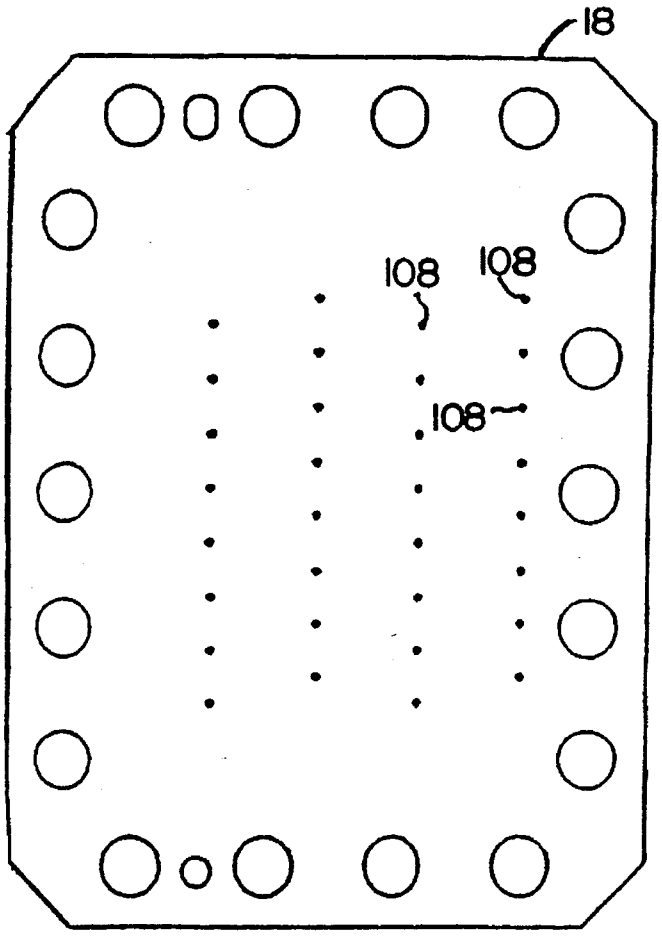
FIG. 11 is a bottom view in plan of the second distribution and mix plate of the spin pack assembly of FIG. 1.

FIGS. 13, 14 and 15 show how the first row or series of pigment mixer channels 113 at the downstream side of first mix plate 16 aligns and interacts with second series 117 on the facing or upstream side of second mix plate 18 to form two flow paths. As illustrated in FIG. 2, the pigment from metering pumps 36, 38 and 40, (for instance yellow, cyan and magenta pigments, the subtractive primary or secondary colors) are proportioned so that when mixed they form a selected color and intensity. The three resulting pigment streams converge from passages 42, 44 and 46, respectively, at port 50 (FIGS. 3 and 4) and partially mix as they flow through passageway 80 (FIG. 1) in screen support plate 14 and into passageway 111 (FIGS. 9 and 13–15). The use of the three subtractive primary input colors permits a wide spectrum of compound or mixed colors to be created by proper proportionings, especially if combined with black and/or white pigments, but fewer or more input pigments of various colors could also be used.

The flow separates into upper channel 113*a* of series 113 in first mix plate 16 and lower channel 117*a* of series 117 in second mix plate 18. The downstream end of channel 113*a* overlaps and communicates with the upstream end of channel 117*b*. Similarly the downstream end of channel 117*a* overlaps and communicates with the upstream end of channel 113*b*. At each such overlap the flow is redirected to a channel defined in the opposed plate. How is thus directed along two paths, a first path beginning in channel 113*a* and continuing along channels 117*b*, 113*c*, 117*d* and so on, and a second path along channels 117*a*, 113*b*, 117*c*, 113*d* and so on, creating a basketweave configuration between the two paths. The two paths intersectingly criss-cross one another midway along each channel creating confluent mixing zones where boundary layer interaction produces further blending of the pigments. More specifically, turbulent shear develops along the surface intersections of the two flows destabilizing the generally laminar patterns and producing diffusing or mixing eddies projecting from each flow into the other. Each time the paths switch from one plate to the other, the flow is inverted so that opposite sides of the flow paths are brought into boundary layer contact on each successive cross-over, thereby enhancing the overall mixing effect.

The two paths reconverge after traversing the combined rows of channels 113 and 117 and the mixed pigment flows through a conduit formed between first and second mix plates 16 and 18, respectively, by the registered alignment of channels 115 and 119, (FIGS. 9 and 10) to the eight sets of partially registered mixer channels 94 and 99. Base polymer metered by pump 54 (FIG. 2) flows through port 52, passageway 62 (FIG. 3), port 64 (FIG. 4) into cavity 56 and through filter screen 67 (FIG. 2), slots 68–74 and finally flows into through-holes 84–91 (FIG. 10) and enters the partially registered mixer channels 94 and 99 (FIGS. 9 and 10) where blending with the mixed pigment by successive alternating boundary layer interaction occurs. The last, or downstream, channels in each of the eight sets communicates with distribution conduits formed by the registry of channels 101 and 105. The color blended polymer flows outward through divergent distribution legs formed by the registry of legs 103 and 107 and hence to through-holes 108 and into the spinning orifices or nozzles 109 in spinneret plate 20 (FIG. 12) where selectively colored fibers are extruded. In one effective embodiment of the present invention at least 80% by volume of the extruded mixture is the base polymer with color pigments or other components contributing properties to the final fiber composing the remaining 20% or less by volume.

Figure 16:
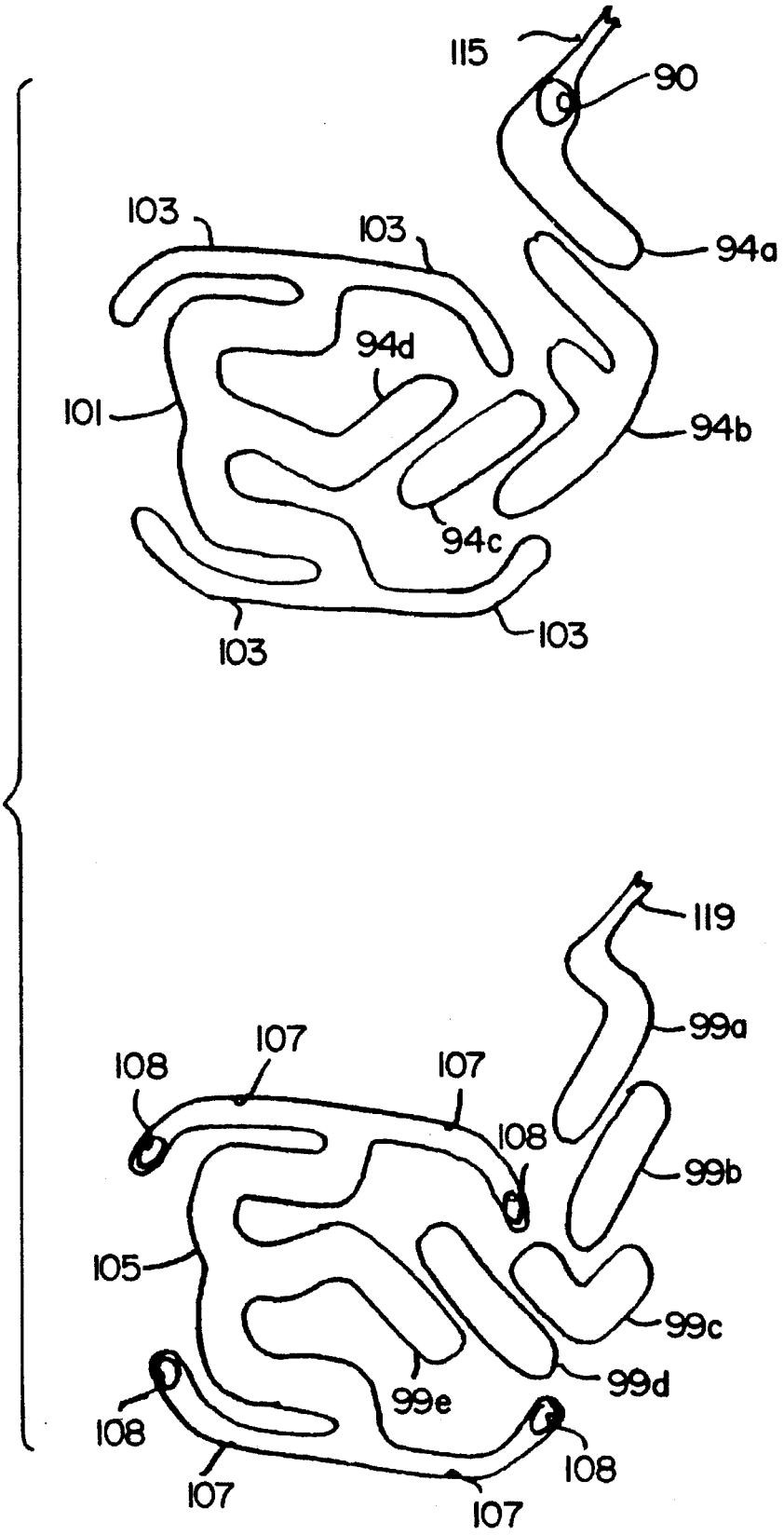
FIG. 16 is an exploded view of the adjacently opposed faces of a portion of the mixer patterns and distribution conduits of the mix plates of FIGS. 8–11.
Figure 17:
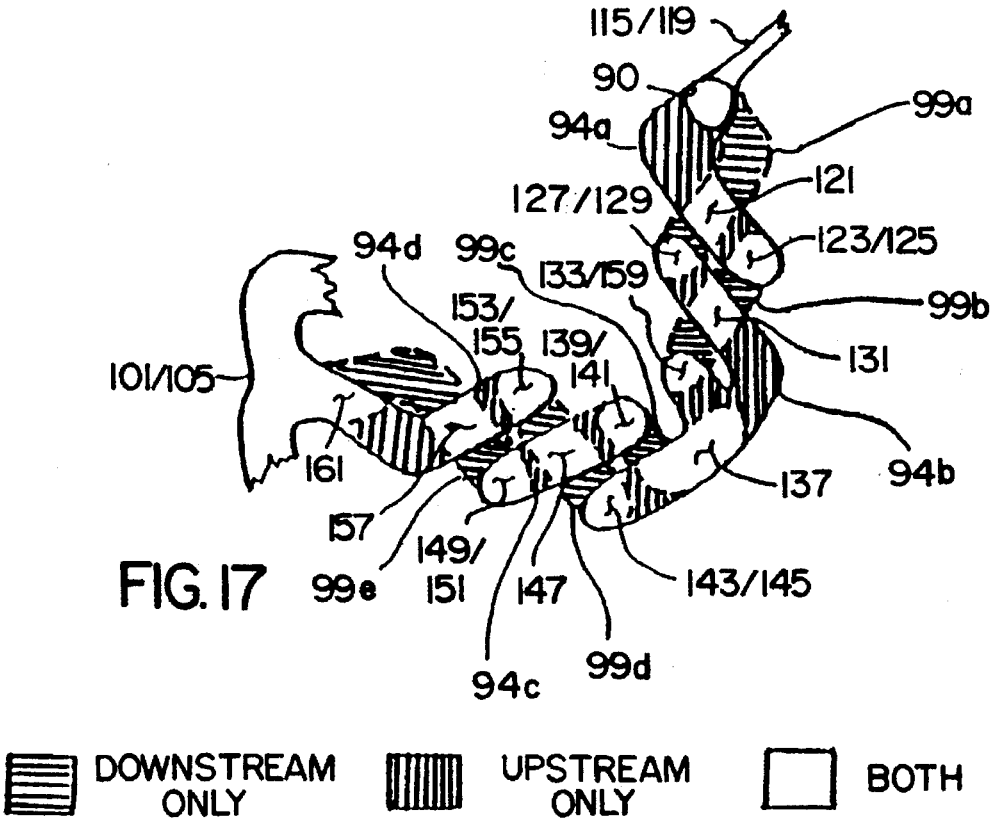
FIG. 17 is a diagram of a portion of the mixer pattern of FIG. 16 indicating the nature of the registry of the adjacently opposed faces.
Figure 18:
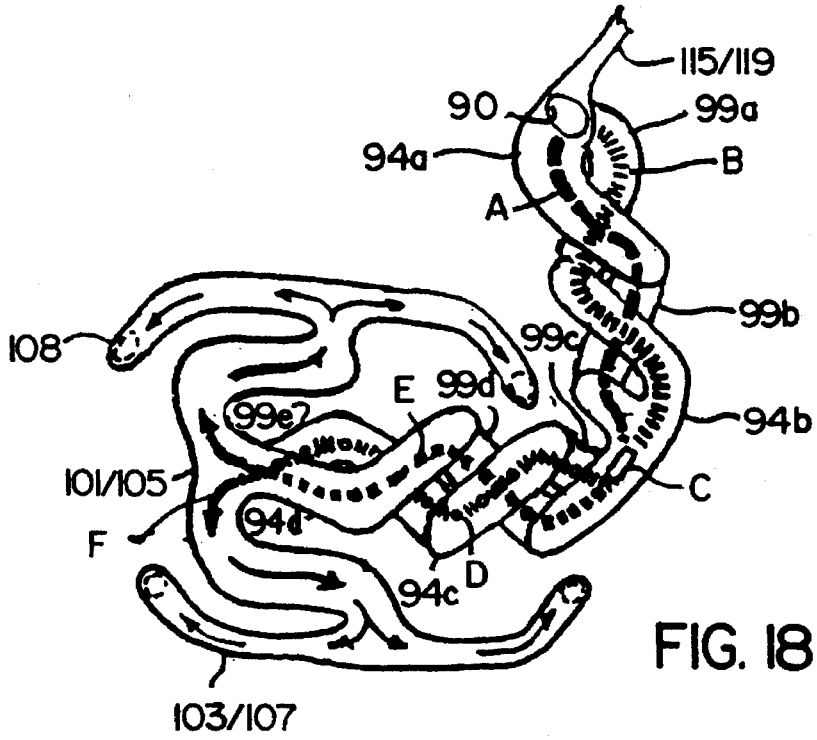
FIG. 18 is a diagram of the flow pattern through the mixer pattern and distribution conduit of FIG. 16.

FIGS. 16–18 show the geometry and flow pattern created by the partially registered sets of mixer channels 94 and 99 on the adjacent surfaces of upstream and downstream mix plates 16 and 18 respectively. Mixed pigment flowing through conduit 115/119 converges with base polymer at through-hole 90 where flow is split into first upstream mixer channel 94*a* and first downstream mixer channel 99*a*. These two channels intersectingly criss-cross each other at 121 near their midlengths at a generally orthogonal orientation to each other, and boundary layer interaction effects partial blending of the two streams. The downstream end 123 of channel 94*a*, the end most distant from through-hole 90, is registered with the upstream or near end 125 of channel 99*b*, and flow is consequently directed into channel 99*b*. Similarly the downstream end 127 of channel 99*a* is registered with the upstream end 129 of channel 94*b* and the pigment-polymer blend flows into channel 94*b*. Channels 94*b* and 99*b* cross each other at about the midpoints of the channels, again in generally orthogonal orientation, creating a second boundary layer interaction blending zone 131.

The downstream end 133 of channel 99*b* is registered with an upstream extension 135 of channel 94*b*, and flow from channels 94*a* and 99*b* converges with flow from channels 99*a* and 94*b* in the middle portion 137 of channel 94*b*. Flow from the two streams is generally parallel in middle portion 137 resulting in somewhat reduced boundary layer mixing.

Channel 99*c* has a generally right angle shape with an upstream leg 139 in registry with the portion of channel 94*b* just downstream of middle portion 137. Converged flow from middle portion 137 is split into a first path extending downstream along channel 99*c* and a second path continuing downstream along channel 94*b*. The downstream end 139 of channel 99*c* is in registry with the upstream end 141 of channel 94*c*, and flow is directed into channel 94*c*. Similarly the downstream end 143 of channel 94*b* is in registry with the upstream end 145 of channel 99*d*, and pigment-polymer flows into channel 99*d* which crosses channel 94*c* in generally orthogonal orientation to form a mixing zone 147. The downstream end 149 of channel 94*c* is in registry with the upstream end 151 of channel 99*c* into which flow is directed. Similarly the downstream end 153 of channel 99*d* is in registry with the upstream end 155 of channel 94*d* and flow continues along this path. Channels 99*c* and 94*d* cross one another in a generally orthogonal orientation to form another mixing zone 159. Flow from channels 94*d* and 99*c* merge together in registry to form a final mixing zone 161 from which the blended pigment and base polymer flows into distribution conduit 101/105.

The flow, as depicted diagrammatically in FIG. 18, is split initially at input through-hole 90 into a first path designated A along channels 94*a*, 99*b* and into 94*b* and a second path B along channels 99*a* and 94*b*, mixing with the flow along path A at the two intersecting cross-overs of the paths. Path A converges with path B midway down channel 94*b* to briefly form a partially blended single path C. Path C splits in the downstream portion of channel 94*b* with first path D flowing along channels 94*b*, 99*c*, 94*c* into 94*e* and a second flow path E along 94*b*, 99*d* and 94*d*, mixing with flow D at two additional cross-over intersections. Flow paths D and E converge as a blend of pigment and polymer at the upstream end of the distribution conduit formed by channels 101 and 105. The pigmented polymer is then distributed to spinneret orifices for extrusion as selectively pigmented fiber.

Figure 19:
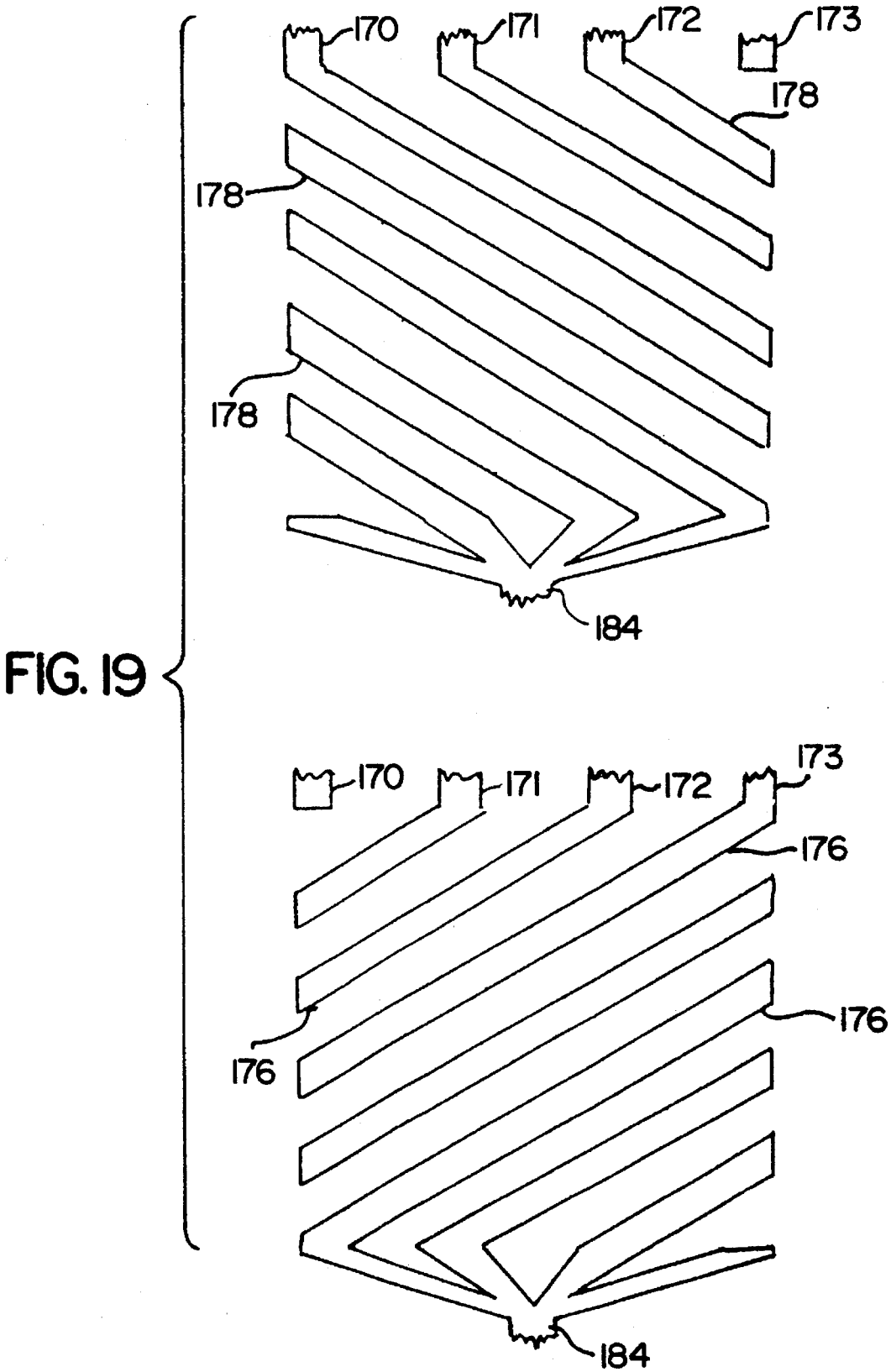
FIG. 19 is an exploded view of the opposed faces of a portion of a mixer pattern having four input streams.
Figure 20:
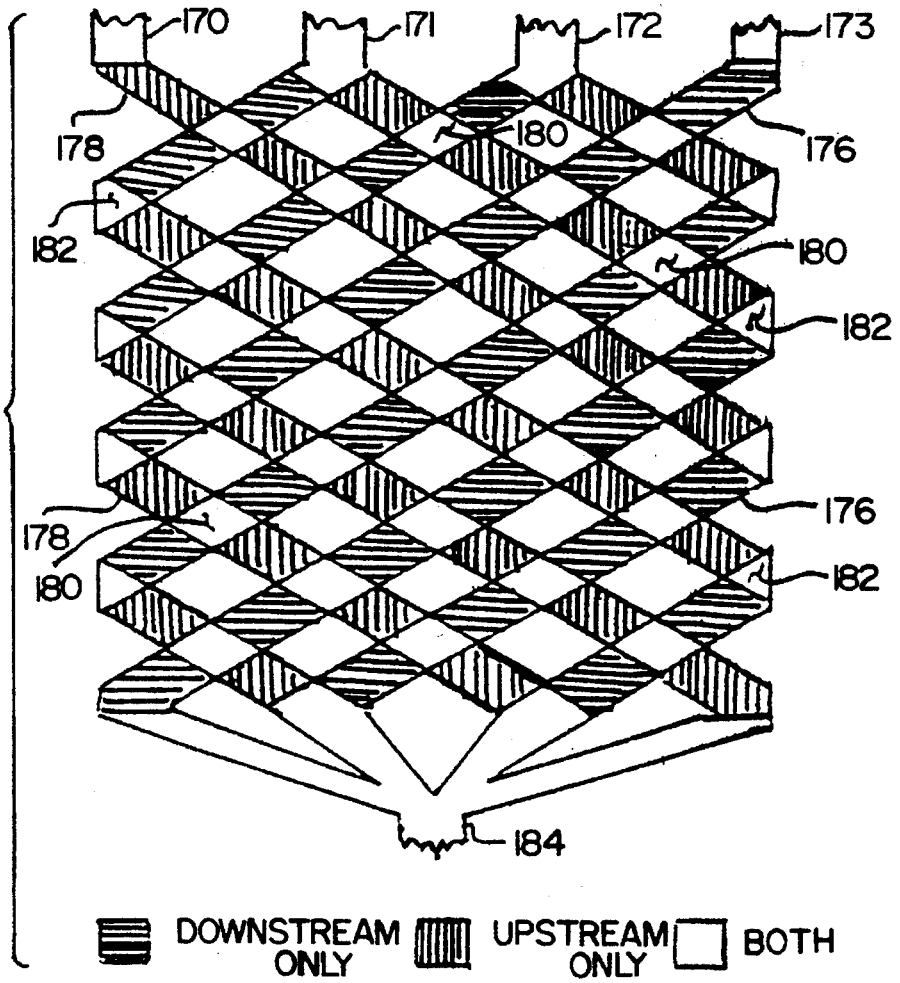
FIG. 20 is a diagram of the mixer pattern of FIG. 19 indicating the nature of the registry of the adjacently opposed faces.

Alternatively, the number of fluid flows to be mixed or blended together is not limited to simply two criss-crossing confluent paths but can be extended and expanded as shown in FIGS. 19 and 20 to any number of paths, each interacting with the others at cross-over intersections and mixing according to the boundary layers in contact. Components enter the opposed plate surface mixing pattern through four input channels 170–173 with each of the inner inputs 171 and 172 splitting into upper and lower paths, outer input channel 170 assuming an initially upper path and outer input channel 173 assuming an initially lower path. Sets of parallel diagonal channels 176 defined in the lower plate lower surface extend generally perpendicular to sets of parallel diagonal channels 178 in the upper plate upper surface with registry occurring at the cross-over points 180 of the channels and at the lateral extremes of the two patterns 182. The mixed fluid reconverges at output channel 184.

Figure 21:
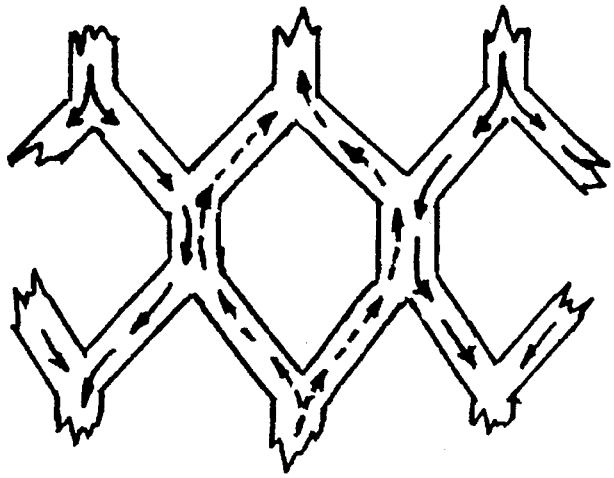
FIG. 21 is a diagram of a portion of a mixer pattern including adjacent flow patterns in side to side coplanar boundary contact.

In each of the preceding embodiments, flow between channels formed in adjacently opposed faces of the two mix plates results in 180° inversions of the fluid flow. Thus mixing is obtained by repeated boundary layer interactions occurring between alternating upper and lower surfaces of the flow streams. It will be appreciated from the context of this disclosure that the terms "mix", "mixing", "mixture", etc., when related to the polymer and/or additive component flows means a blending or amalgamation of the flowing materials resulting in spun fibers consisting of intermixed, rather than side by side, components. This intermixing, it should be emphasized, is not restricted to blending color pigments into a base polymer. Any flowable additive component can be metered into a spin pack according to the present invention for mixture with a base polymer. Additional mix plates can be included to permit virtually unlimited numbers and orientations of flow interactions and the geometry of the mix plate pattern can be varied to produce any number or type of boundary layer interactions, including coplanar confluence of flow patterns as illustrated in FIG. 21.

From the foregoing description, it will be appreciated that the present invention provides a method and apparatus that permits the selective and controllable mixing of additive components and base polymer in an inexpensive spin pack at a location in the synthetic fiber manufacturing process very close to the final spinneret extrusion point. This minimizes the amount and residence time of mixed polymer in the spin pack to allow a wide range of nearly instantaneous changes to be made with little disruptive and costly material waste or cleaning and flushing of equipment.

Having described preferred embodiments of a new and improved mixer spin pack according to the present invention, it is believed that other modifications, variations and changes will be suggested to persons skilled in the art in view of the teachings contained herein and that all such variations, modifications and changes fall within the scope of the present invention as defined by the appended claims.

What is claimed is:

1. A method of forming mixed composition fibers having preselected characteristics comprising the steps of:

(a) metering a molten base polymer into a spin pack assembly;

(b) metering at least one molten additive fiber component into said spin pack assembly;

(c) mixing said molten base polymer with said at least one additive fiber component within said spin pack to produce a molten mixed composition fiber material having preselected characteristics; and (d) extruding said mixed composition fiber material through a spinneret plate to produce fibers having said preselected characteristics.

2. The method of claim 1 wherein said additive fiber components are pigment containing materials.

3. The method of claim 1 wherein said additive fiber components include each of three primary colors proportioned to produce a mixture having preselected color.

4. The method of claim 1 wherein the metered molten polymer comprises at least 80% by volume of the molten fiber material mixture.

5. A method of forming composite fibers comprising the steps of:

(a) metering a molten polymer into a spin pack assembly;

(b) metering a plurality of molten additive fiber components into said spin pack assembly;

(c) mixing said plurality of molten additive fiber components together;

(d) mixing said molten polymer with said mixed additive components to produce a composite fiber mixture having characteristics predetermined by the proportions of polymer and components metered into said spin pack assembly; and (e) extruding said mixture through a spinneret plate to produce fibers having preselected composite characteristics.

6. The method of claim 5 wherein said additive components include each of three primary color pigments proportioned to produce a mixture having a preselected color.

7. The method of claim 5 wherein said mixing is produced by flowing said polymer and said plurality of molten additive fiber components through a plurality of paths defined between juxtaposed faces of upstream and downstream plates in said spin pack, said paths having a plurality of zones of confluence wherein boundary layer interactions of the confluent flows result in blending of said polymer and said additive components.

8. A method of rapidly and selectively mixing and changing the color of extruded polymer fiber, said method comprising the steps of:

(a) flowing molten polymer into a multi-plate spin pack;

(b) flowing metered amounts of at least one polymer pigment into said spin-pack in amounts proportioned to produce a desired first color of extruded polymer fiber;

(c) mixing said at least one pigment by splitting the input pigment flow into at least two paths defined between juxtaposed faces of an upstream and an adjacent downstream plate, said at least two paths having a plurality of zones of confluence wherein boundary layer interactions of the confluent pigment flow results in a blending of said at least one pigment into a mixed pigment;

(d) reconverging said at least two pigment mixing paths into a single mixed pigment passageway defined between said upstream and downstream plates;

(e) distributing said molten polymer to an array of polymer inlet holes in said upstream plate;

(f) distributing said mixed pigment to each of said array of inlet holes via paths defined between said upstream and downstream plates communicating between said single mixed pigment passageway and said array of inlet holes;

(g) converging said mixed pigment with said polymer at said inlet holes;

(h) mixing said mixed pigment and polymer converged at each inlet hole by splitting each converged flow of mixed pigment and polymer into at least two paths defined between the abutting faces of said upstream and downstream plates, said each of at least two paths having a plurality of zones of confluence wherein boundary layer interactions of the confluent mixed pigment and polymer flow results in a blending of said mixed pigment and polymer;

(i) reconverging each of said at least two pigment and polymer paths into single mixed pigment and polymer passageways defined between said upstream and downstream plates;

(j) distributing said mixed pigment and polymer to arrays of outlet through-holes in said downstream plate via paths defined between said upstream and downstream plates, said arrays arranged around each of said inlet holes;

(k) flowing said mixed pigment and polymer through said outlet through-holes into spinning holes in a spinneret plate on the downstream side of said downstream plate for extruding as selectively colored polymer fiber;

(l) selectively changing the metered amounts of said at least one pigment to produce a proportion corresponding to a second desired color of extruded polymer fiber; and (m) discarding the small amount of fiber produced during the transition period while said changes in metered amounts of pigments are made.

9. The method of claim 8 wherein said flowing of molten polymer is stopped during said pigment change transition period.

10. The method of claim 8 wherein each of said paths from said polymer inlet holes to said spinning holes is formed to have the same length.

11. The method of claim 8 wherein said at least one polymer pigment includes three generally subtractive primary colors.

12. The method of claim 8 wherein said at least one polymer pigment includes three generally subtractive primary colors and white.

13. A method of mixing a plurality of input flows of polymer and pigment comprising the steps of:

(a) directing said flows into the upstream side a spin pack formed of adjacently opposed plates;

(b) further directing said flows into a pattern of mixing channels defined in partial registry on opposed adjacent surfaces of said spin pack plates;

(c) directing said flows through said pattern so that separate flow paths intersectingly criss-cross in overlapping communication with each other to form boundary layer interactions producing mixed flows in said channels; and (d) directing said mixed flows out of the downstream side of said spin pack.

14. The method of claim 13 wherein step (c) further includes the step of:

(c.1) converging said mixed flows into at least one distribution channel defined in registry on opposed adjacent surfaces of said spin pack plates.

15. The method of claim 14 wherein step (c) further comprises the step of:

(c.2) distributing said mixed flows through a plurality of distribution channels defined in registry on opposed adjacent surfaces of said spin pack plates to a plurality of spaced through-holes defined in the downstream side of said spin pack.

16. The method of claim 15 wherein said plurality of spaced through-holes are in aligned communication with the nozzles of a downstream spinneret.

17. A method of mixing a plurality of input flows at least one of which is a molten polymer to form composite fibers, said method comprising the steps of:

(a) metering said flows into a spin pack assembly;

(b) directing said flows through a plurality of paths defined between juxtaposed faces of an upstream and a downstream plate in said spin pack, said paths having a plurality of zones of confluence wherein boundary layer interactions of the confluent flow results in blending of said flows into a composite mixture; and (c) extruding said blended mixture through a spinneret plate to produce composite fibers.

18. The method of claim 17 wherein said plurality of input flows includes at least one pigment-containing material.

19. The method of claim 17 wherein said plurality of input flows includes pigment-containing material from each of three generally subtractive primary colors.

20. The method of claim 17 wherein said plurality of input flows includes pigment-containing material from each of three generally subtractive primary colors and white.

21. A method of forming composite fibers comprising the steps of:

(a) flowing molten polymer into a multi-plate spin pack;

(b) flowing metered amounts of at least one polymer pigment into said spin-pack in amounts proportioned to produce a desired first color of extruded polymer fiber;

(c) mixing said at least one pigment by splitting the input pigment flow into at least two paths defined between juxtaposed faces of an upstream and an adjacent downstream plate, said at least two paths having a plurality of zones of confluence wherein boundary layer interactions of the confluent pigment flow results in a blending of said at least one pigment into a mixed pigment;

(d) reconverging said at least two pigment mixing paths into a single mixed pigment passageway defined between said upstream and downstream plates;

(e) distributing said molten polymer to an array of polymer inlet holes in said upstream plate;

(f) distributing said mixed pigment to each of said array of inlet holes via paths defined between said upstream and downstream plates communicating between said single mixed pigment passageway and said array of inlet holes;

(g) converging said mixed pigment with said polymer at said inlet holes;

(h) mixing said mixed pigment and polymer converged at each inlet hole by splitting each converged flow of mixed pigment and polymer into at least two paths defined between the abutting faces of said upstream and downstream plates, said each of at least two paths having a plurality of zones of confluence wherein boundary layer interactions of the confluent mixed pigment and polymer flow results in a blending of said mixed pigment and polymer;

(i) reconverging each of said at least two pigment and polymer paths into single mixed pigment and polymer passageways defined between said upstream and downstream plates;

(j) distributing said mixed pigment and polymer to arrays of outlet through-holes in said downstream plate via paths defined between said upstream and downstream plates, said arrays arranged around each of said inlet holes; and (k) flowing said mixed pigment and polymer through said outlet through-holes into spinning holes in a spinneret plate on the downstream side of said downstream plate for extruding as selectively colored polymer fiber.

22. A method of imparting color to an extruded polymer fiber, said method comprising the steps of:

(a) flowing molten polymer into a multi-plate spin pack;

(b) flowing metered amounts of a plurality of polymer pigments as an input flow into said spin-pack in amounts proportioned to produce a desired first color of extruded polymer fiber;

(c) mixing said pigments by splitting the input pigment flow containing the plurality of polymer pigments into a plurality of pigment flow paths defined between juxtaposed faces of an upstream and an adjacent downstream plate, said pigment flow paths having a plurality of zones of confluence wherein boundary layer interactions of the confluent pigment flow results in a blending of said pigments in the pigment flow paths;

(d) reconverging said pigment in said pigment flow paths into a single mixed pigment in a pigment passageway defined between said upstream and downstream plates;

(e) distributing said molten polymer to an array of polymer inlet holes in said upstream plate;

(f) distributing said mixed pigment to each of said array of inlet holes via paths defined between said upstream and downstream plates communicating between said single mixed pigment passageway and said array of inlet holes;

(g) converging said mixed pigment with said polymer at said inlet holes to produce a mixture of mixed pigment and polymer;

(h) mixing said mixed pigment and polymer converged at each inlet hole by splitting each converged flow of mixed pigment and polymer into at least two paths, each path containing mixed pigment and polymer and each path being defined between the abutting faces of said upstream and downstream plates, wherein said paths have a plurality of zones of confluence wherein boundary layer interactions of the confluent mixed pigment and polymer flow results in a further blending of said mixed pigment and polymer;

(i) reconverging each of said interacting pigment and polymer paths into single mixed pigment and polymer passageways defined between said upstream and downstream plates;

(j) distributing said mixed pigment and polymer to arrays of outlet through-holes in said downstream plate via paths defined between said upstream and downstream plates, said arrays arranged around each of said inlet holes; and (k) flowing said mixed pigment and polymer through said outlet through-holes into spinning holes in a spinneret plate on the downstream side of said downstream plate for extruding as selectively colored polymer fiber.

23. The method of claim 2 wherein said mixing comprises flowing said base polymer and said additive fiber components through a plurality of paths defined between juxtaposed faces of upstream and downstream plates in said spin pack, said paths having a plurality of zones of confluence wherein boundary layer interactions of confluent flows result in blending of said base polymer and said additive components.

24. The method of claim 1 wherein said mixing comprises flowing said base polymer and said at least one additive fiber component through a plurality of paths defined between juxtaposed faces of upstream and downstream plates in said spin pack, said paths having a plurality of zones of confluence wherein boundary layer interactions of confluent flows result in blending of said base polymer and said additive components.

* * * * *